US007921474B2

(12) United States Patent
Miller

(10) Patent No.: US 7,921,474 B2
(45) Date of Patent: Apr. 12, 2011

(54) INSIDE BELT

(76) Inventor: Edward A. Miller, Laguna Woods, CA (US)

( * ) Notice: Subject to any disclaimer, the term of this patent is extended or adjusted under 35 U.S.C. 154(b) by 624 days.

(21) Appl. No.: 11/977,546

(22) Filed: Oct. 25, 2007

(65) Prior Publication Data

US 2008/0313790 A1 Dec. 25, 2008

Related U.S. Application Data

(60) Provisional application No. 60/936,759, filed on Jun. 23, 2007.

(51) Int. Cl.
*A41F 9/00* (2006.01)

(52) U.S. Cl. ..... 2/338

(58) Field of Classification Search ..... 2/220, 221, 2/235, 237, 311, 312, 315, 316, 317, 318, 2/319, 321, 322, 323, 338, 339
See application file for complete search history.

(56) References Cited

U.S. PATENT DOCUMENTS 683,720 A * 10/1901 Arnold ..... 2/308
809,074 A 1/1906 Niles
822,076 A * 5/1906 Rhodes ..... 2/319
957,117 A * 5/1910 Snow ..... 2/310
966,093 A 8/1910 Hilgert
1,039,995 A 10/1912 Niles
1,059,603 A * 4/1913 Fritz ..... 2/304
1,084,565 A 1/1914 Simmons
1,107,158 A * 8/1914 Day ..... 2/236
1,206,070 A * 11/1916 Wohlgemuth ..... 2/308
1,233,958 A 7/1917 Baker
1,246,684 A 11/1917 Turnage
1,272,754 A 7/1918 Woods
1,294,374 A 2/1919 Arons
1,297,158 A 3/1919 Hawkins, Jr.
1,307,503 A 6/1919 Leak
(Continued)

OTHER PUBLICATIONS

Photographs of a prototype belt displayed before the filing of the present patent application.

*Primary Examiner* — Alissa L Hoey
(74) *Attorney, Agent, or Firm* — Stetina Brunda Garred & Brucker; Lowell Anderson

(57) ABSTRACT

An inner belt fits along the juncture of a person's stomach and thighs. The inner belt has first and second arches with a garment supported by the arch and the arch sized to offset the garment's waistline from the inner belt. Each arch has a front end a rear end fastened to the inner belt. The front end of each arch is located so it fastens to the inner belt adjacent the user's crotch during use. The rear end of each arch is located so it fastens to the inner belt at or before the hips of the user during use. A first loop extends from each arch, over the waistline and a normal, outer belt threads through the first loops and also through the normal belt loops on the garment. The outer belt supports the garment and the first loop and arches support the outer belt in a position offset from the inner belt. One or more second loops can optionally be fastened to the back of the inner belt to extend over the waistline and support the outer belt along the user's back. Localized stiffeners can be added to the first and second loops, inner belt and arches in order to keep the top of the loops above the waistline and reduce distortion of the waistline where the loops connect to the outer belt.

6 Claims, 9 Drawing Sheets

U.S. PATENT DOCUMENTS

| | | | | | |
|---|---|---|---|---|---|
| 1,464,744 | A | | 8/1923 | Bowe | |
| 1,513,522 | A | * | 10/1924 | Ross | 2/337 |
| 2,505,383 | A | | 4/1950 | Brunson | |
| 2,705,328 | A | | 4/1955 | Felix | |
| 2,765,470 | A | | 10/1956 | Read | |
| 2,946,064 | A | | 7/1960 | Dieterle | |
| 3,091,772 | A | * | 6/1963 | Hebras | 2/221 |
| 4,188,672 | A | * | 2/1980 | Kalso | 2/221 |
| 4,498,201 | A | | 2/1985 | Carter | |
| 5,351,340 | A | * | 10/1994 | Aldridge | 2/108 |
| 5,373,587 | A | * | 12/1994 | Sexton | 2/237 |
| 5,867,836 | A | * | 2/1999 | Quinones | 2/236 |
| 6,219,848 | B1 | * | 4/2001 | Russell | 2/221 |
| 6,308,338 | B1 | * | 10/2001 | Caldwell | 2/312 |
| 6,327,714 | B1 | * | 12/2001 | Koerner | 2/236 |
| 6,446,269 | B1 | * | 9/2002 | Bessler et al. | 2/321 |
| 2003/0182715 | A1 | * | 10/2003 | Wallace | 2/338 |
| 2004/0163159 | A1 | * | 8/2004 | Edwards et al. | 2/338 |
| 2008/0104741 | A1 | | 5/2008 | Miller | |
| 2008/0172769 | A1 | * | 7/2008 | Herget | 2/76 |
| 2010/0229284 | A1 | * | 9/2010 | Wilson, II | 2/237 |

* cited by examiner

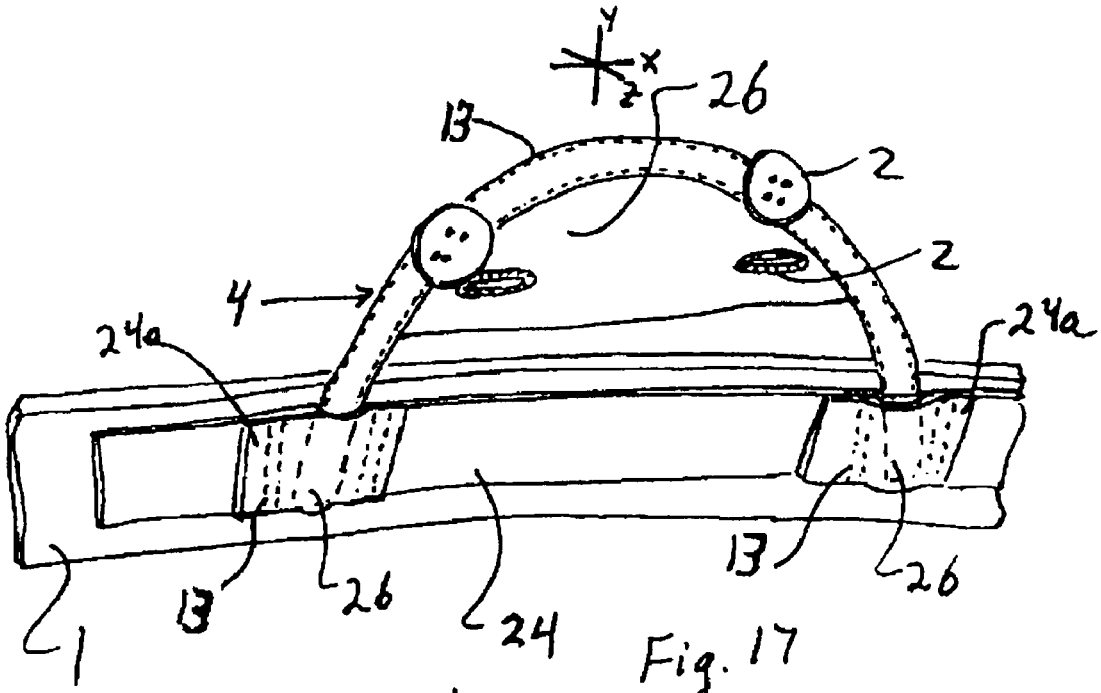
Fig. 17
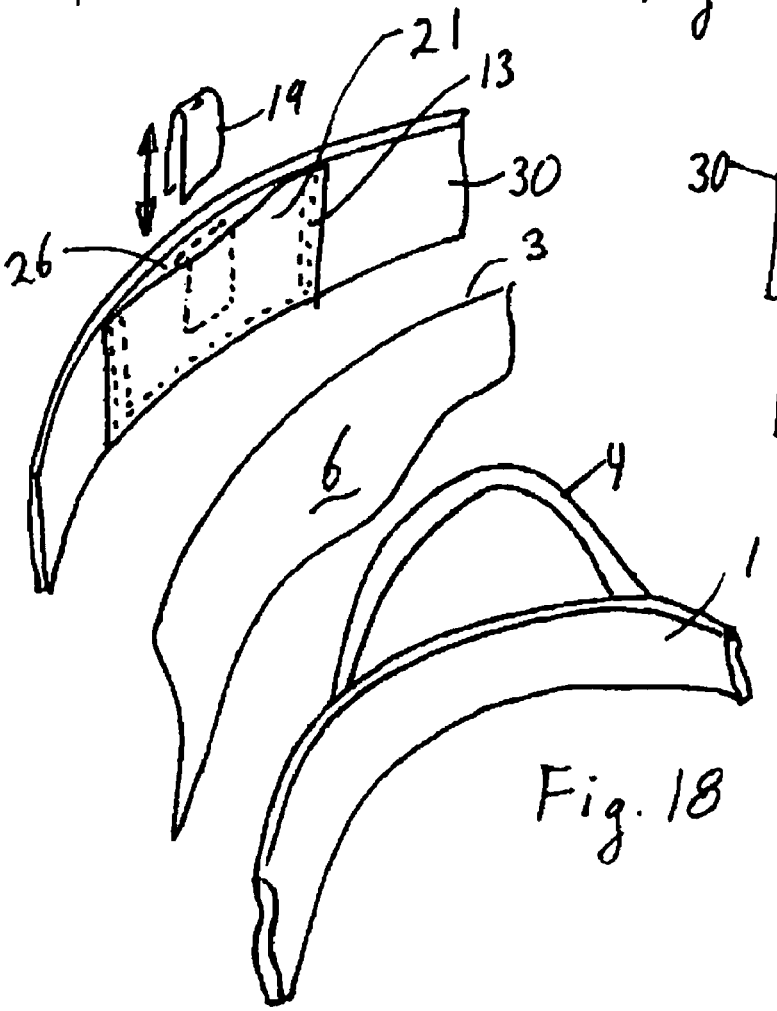
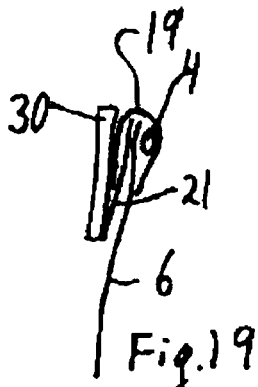
Fig. 19
Fig. 18

INSIDE BELT

CROSS-REFERENCE TO RELATED APPLICATIONS

This application claims the benefit under 35 U.S.C. §119 (e) of application Ser. No. 60/936,759 filed Jun. 23, 2007, the complete contents of which are incorporated herein by reference.

BACKGROUND

A person with a discernable paunch or stomach typically pulls an external belt tight in order to maintain a level waistline on the person's pants, skirt or garment. That is very uncomfortable, especially when the user bends over. Some persons with extending stomachs will allow the stomach to protrude over the belt, so the waistline curves downward toward the person's crotch, and that presents an unattractive appearance. There is thus a need for a garment that maintains a level waistline even if the user has a pronounced stomach, while allowing the user to move freely and without squeezing the person's stomach.

Some dress styles allow the waistline of a person's pants to ride very low on the waist so it looks like the pants are falling off—which they are. In such cases the user continually repositions the pants to maintain them in a low-ridding position without allowing the pants to fall onto the user's legs. There is a need to position a waistline at a desired position and to maintain that waistline position without repeated manual adjustment.

BRIEF SUMMARY

An inner belt and garment fasten around a user's waist with the inner belt being configured to support the waistline of the garment at a selected waistline position. The inner belt has first and second arches with each arch having a front end a rear end fastened to the inner belt. The front end of each arch is located so it fastens to the inner belt adjacent the user's crotch during use. The rear end of each arch is located so it fastens to the inner belt at or before the hips of the user during use. A first loop extends from the arch over the garment's waistline where a normal, external belt threads through the first loops as well as threading through the normal external loops on the garment.

The external belt carries the weight of the garment and the first loops and arches transfer that weight from the external belt to the inner belt. Since the inner belt follows the natural curves along the juncture of the stomach and thighs the inner belt is comfortable. The arches offset the waistline vertically from the lower position of the inner belt and allow the user to maintain a level or straight waistline. The first loops transfer the weight of the garment from the external belt to the arches and inner belt. In use, the garment's belt loops rest against the top edge of the outer belt, while the bottom edge of that outer belt rests against the bottom of the loops that are connected to the inner belt either directly, or by the offsetting arches or localized stiffeners. By supporting the weight of the garment on the inner belt which is concealed from view by the garment, the outer belt and waistline of the garment can be held at any desired position and thereby avoid the unsightly appearance of a stomach overhanging the garment's waistline. It is not necessary to have the garment and/or belt tight around the waist since this design supports the garment with the inside belt. This allows for a comfortable fit even when sitting or bending.

A second loop is optionally added at the back of the inner belt to connect the inner belt to the external belt. Less offset is needed at the user's back so arches are not believed necessary. A local stiffener fastened to the second loop and inner belt and extending above the inner belt and waistline advantageously positions the top of the second loop above the waistline and prevents local distortion of the waistline. Similar stiffeners can be added to the first loops on the arches to avoid distorting the waistline.

There is also advantageously provided a method of supporting a garment worn around a user's waist using a garment having a waistband with a waistline with a plurality of external belt loops. An external belt is threaded through the external belt loops. This method is especially useful when the user has an extending stomach, along with the normal thighs and hips, and a crotch between the thighs and hips. The method includes placing an inner belt along the juncture of the stomach and thighs. The inner belt has two arches located on opposing sides of the crotch with each arch having a front end adjacent the crotch and a rear end adjacent and in front of the hips. The inner belt has at least one first loop supported by each arch, and at least one second loop supported by the belt and located between the rear ends of the arches. The exterior belt is threaded through the external belt loops and supports the weight of the garment on the external belt. The exterior belt is also threaded through the first and second loops and supports the weight of the external belt on the inner belt and arches.

In further variations of this basis method, the external belt is supported on or connected to each arch by two first loops on each arch. Further, the method includes forming the inner belt of two portions with each portion connected to one arch and then connecting the two portions with an adjustable length connector located between the rear ends of the arches. Because the arches are adjacent the user's crotch at the front of the garment, a large adjustment of the inner belt using a normal belt buckle adjustment at the front will shift the location of one arch relative to the other arch. Thus, an inner belt with a length adjustment at the back of the user is desirable. The inner belt is thus advantageously formed of two portions each of which is connected to one arch and these two portions are connected with an adjustable length connector located between the second ends of the arches and further located along the user's back during use. Further, the method includes supporting a top of the first loops above the waistline of the garment. That helps prevent the first loop from distorting the waistline and also helps prevent the arch from showing above the waistline.

Preferably, but optionally, each arch is made of flexible material and designed to flex and enable the arch to conform to the general body shape. Advantageously, each arch is not symmetric, but is inclined toward the other arch so the top of each arch is fairly flat so the arch can be fastened to the horizontal waistband of a garment. Moreover, each arch can be doubly curved to conform to the general shape of an extending stomach. Optionally, each arch is permanently fastened to the garment, although the arches are preferably releasably fastened to the garment. Optionally, each arch is permanently fastened to the inner belt, although the arches are preferably releasably fastened to the inner belt. Preferably, but optionally, the front and back ends of the arch are stiffer than the portion of the arch between those front and back ends.

There is also provided an assembly that includes an inner belt and a garment for fastening around a user's waist. The garment has a waistline with external belt loops adjacent the waistline for use with an external belt threading along a normal path through those external belt loops. The inner belt has opposing distal ends releasably fastenable together and located inside the garment. The assembly includes first and second arches each having a front end a rear end fastened to the inner belt adjacent the distal ends of the inner belt. The front end of each arch is located so it fastens to the inner belt adjacent the user's crotch during use of the assembly. The rear end is located so it fastens to the inner belt at or slightly before the hips of the user during use.

Further, the assembly has at least two first loops each supported by a different one of the arches and located between the front and rear ends of the arch. The first loops are located adjacent a top of the arch and have a length sufficient to pass over the waistline and align with the normal path of the external belt through the external belt loops during use of the assembly. Moreover, the inner belt optionally has at least one second loop connected thereto and located between the two arches and at a portion of the inner belt located at the user's back during use of the assembly. The second loop also has a length sufficient to pass over the waistline and align with the normal path of the external belt through the external belt loops during use of the assembly. In use, an external belt is threaded through the first and second loops and through the external belt loops.

The arches can be made and connected in the various ways that are described later in this summary. But each arch is preferably connected to a tab which is connected to the first loop, with the tab being located and constructed to hold a top of that first loop above the waistline during use of the assembly. Further, each arch is preferably, but optionally connected to two tabs, each of which are connected to first loops. These two tabs are located and constructed to hold a top of the first loops above the waistline during use of the assembly. Again, an external belt is threaded through the first loops and the second loop. The inner belt preferably has a two part construction with an adjustable portion located by the user's back during use of the assembly. A stiffener is optionally provided at the location of a plurality of the first or second loops. The stiffeners are connected to one of the arches or inner belt sufficiently to hold a top of the plurality of loops adjacent the waistline during use of the apparatus.

There is also advantageously provided an inner belt for use with a garment having a plurality of exterior belt loops for use with an external belt threading along a normal path through those external belt loops. The inner belt with opposing distal ends has the belt configured to fit along the contour of a user's stomach adjacent the juncture of the stomach and legs, the inner belt further configured to pass over the user's hips and across the user's back during use of the inner belt. The belt has a releasable belt fastening mechanism on at least one distal end to releasably engage the ends of the belt. There are also first and second arches fastened to the inner belt where each arch has a front end a rear end with the front end of each arch fastened adjacent a different distal end of the inner belt. The front end of each arch is located so it fastens to the inner belt adjacent the user's crotch during use of the inner belt. The rear end of each arch is located so it fastens to the inner belt at or before the hips of the user during use of the inner belt. The inner belt also has at least two first loops each supported by a different one of the arches and located between the front and rear ends of the arch and further located adjacent a top of the arch. The first loop has a length sufficient to pass over the waistline and align with the normal path of the external belt through the external belt loops during use of the assembly.

Variations of this basic belt include at least one second loop connected to the inner belt and located between the two arches and at a portion of the inner belt located at the user's back during use of the inner belt. Like the first loop, the second loop also has a length sufficient to pass over the waistline and align with the normal path of the external belt through the external belt loops during use of the assembly. The arches and first loop support the front of the garment off of the inner belt and the second loop supports the rear of the garment off of the inner belt. The arches are described later. But there are preferably two first loops on each arch with the loops located so the top of each loop is on a generally level line during use of the inner belt. That helps keep the garment's waistline straight or level. Each of these two first loops are spaced about 2 to 2.5 inches apart, and that helps place one of these loops adjacent the external belt loops on a garment to more directly transfer the weight of the garment to the first loops and thus to the inner belt..

Further, a stiffener is advantageously fastened to a plurality of the first loops and fastens to the belt or to material connected to the belt in order to position a top of the first loops above the arch and to position the top of the second loop above the waistline of the garment. The stiffeners help transmit the weight from the external belt to the internal belt without locally distorting the waistline.

The inner belt advantageously has a length adjustment located between the two arches, adjacent the user's back when the inner belt is used. The inner belt thus advantageously has two portions connected by an adjustable length connector located at back of the user during use of the garment.

There are other, but less useful ways to fasten the inner belt to the garment in which an inner belt and garment fasten around a user's waist with the inner belt being configured to support the waistline of the garment at a selected waistline position. The inner belt has first and second arches with each arch having a front end a rear end fastened to the inner belt. The front end of each arch is located so it fastens to the inner belt adjacent the user's crotch during use. The rear end of each arch is located so it fastens to the inner belt at or before the hips of the user during use. Two first fasteners are connected to a different one of the arches adjacent a top of the arch. The garment has two second fasteners, preferably but optionally connected to a waistband of the garment. Each of the second fasteners is located to releasably engage one of the first fasteners to fasten the arch to the garment so the arches hold the waistline of the garment above the inner belt. The garment preferably covers the inner belt and arches, so the inner belt is inside the garment. The garment is optionally connected to the inner belt by a third fastener located between the arches, along the user's back. More than one fastener could be located along the user's back to connect the inner belt to the garment. The garment can fasten to the arches using a single fastener, or by using two or more fasteners.

There is also provided an improved inner belt to be worn underneath a garment, the inner belt having opposing distal ends. The inner belt further has first and second arches each having a front end a rear end fastened to the inner belt. The front end of each arch is fastened adjacent a different end of the inner belt. The front end of each arch is located so it fastens to the inner belt adjacent the user's crotch during use. The rear end of each arch is located so it fastens to the inner belt at or before the hips of the user during use. At least two first fasteners are each connected to a different one of the arches between the front and rear ends and adjacent a top of the arch.

Each arch is preferably not symmetric, but is inclined toward the other arch. Moreover, each arch is doubly curved to conform to the general shape of an extending stomach. Further, there are preferably, but optionally two first fasteners on each arch with the fasteners located on a generally level line. Optionally, the arches are permanently fastened to a garment. Optionally, the arches are permanently fastened to the inner belt. Preferably, the front and back ends of the arch are stiffer than the portion of the arch between those front and back ends. The fasteners are preferably releasable fasteners so the arch is releasably fastened to the garment, to the inner belt, or to both the garment and the inner belt.

There is also advantageously provided a garment having a waistband for use with an inner belt support, where the inner belt support has two arches that extend from the inner belt to the waistband. The garment has at least two fasteners connected to the garment adjacent the waistline of the garment and on the waistband. Each of the at least two fasteners is located to engage a different one of the arches. The garment also has an optional third fastener located between the two fasteners and further located to be on the back of the user during use. The third fastener can include more than one fastener.

Preferably, but optionally, there are two fasteners on each arch and two second fasteners on the garment, with all of these fasteners located on a generally level line. Preferably the fasteners on the garment are releasable fasteners, although optimally the garment could be permanently connected to the arches.

There is also advantageously provided a method of supporting a garment worn around a user's waist. The garment has a waistband with a waistline and the user has an extending stomach with thighs and hips and with a crotch between the thighs and hips. The method includes placing a inner belt along the juncture of the stomach and thighs where the inner belt has two arches located on opposing sides of the crotch with each arch having a front end adjacent the crotch and a rear end adjacent and in front of the hips. The method further includes supporting the waistline at a selected position by fastening the garment to the arches to cover the arches and inner belt where the arches are sized and positioned to support the waistline at the selected position.

In further variations, the method also includes supporting the waistline by fastening the garment to the inner belt at a location between the hips and along a back of the user. Further variations also include fastening the garment to each arch at two locations. Further, the method can include fastening at least one button to each arch where the button is sized slightly smaller than a width of the waistband and then placing the butting through a slit on the inside of the waistband where the slit extends along a length of the waistband. Advantageously, the slit is formed in a piece of material that is then sewn to or clipped to the waistband.

In still further variations, the method can optionally include permanently fastening the arches to the inner belt, or permanently fastening the arches to the garment, or both, although preferably they are all releasably fastened together.

BRIEF DESCRIPTION OF THE DRAWINGS

These and other features and advantages of the various embodiments disclosed herein will be better understood with respect to the following description and drawings, in which like numbers refer to like parts throughout, and in which:

FIG. 17 is a partial perspective view showing an outside view of an arch connected to a inner belt, with an alternative fastening mechanism;

FIG. 18 is a partial perspective view of an external belt fastened to a garment and optionally fastened to the arch and inner belt of FIG. 1;

FIG. 19 is a sectional view showing the external belt and garment of FIG. 18 fastened to the arch on the inner belt of Fig.

DETAILED DESCRIPTION

Figure 1:
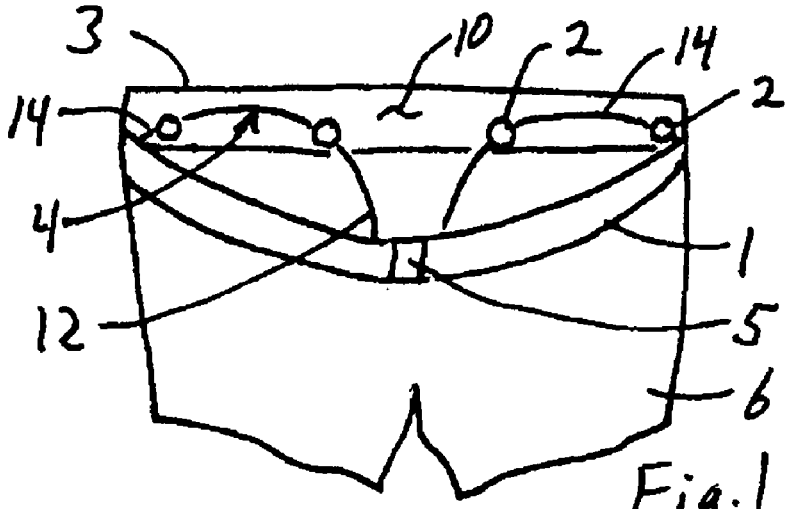
FIG. 1 is a front plan view of a preferred embodiment of an inner belt with arches that are attached to a garment.

FIGS. 1-5 and 7 show a flexible inner belt 1 with a connector 5, such as a belt buckle. The inner belt 1 is placed along the natural curves of a person's body between the stomach and the upper thighs and buttock. This natural curvature becomes more pronounced as the stomach enlarges. This belt is for use by persons having a noticeable stomach, persons who typically, if they tighten their belt will compress their stomach to an uncomfortable degree. Thus, there is typically a discernable or even a pronounced curvature between such a person's thighs and stomach, and the belt fits into the area of this curvature. The inner belt 1 is fastened so it does not constrict the overhanging stomach at the waistline 3 of the garment 6. The inner belt 1 optionally has one or more buttons, snaps, toggles, hooks, hook-and-loop connections, belt and loop connection, or other types of fasteners 2 along the part of the belt that abuts the wearer's back.

A flexible arch 4 is fastened so it extends above the top edge of the inner belt 1 a distance sufficient to reach the waistband 10 adjacent the waistline 3 of the user's garment 6 (pants, skirt, etc.) A fastener 2 is also located at the top of each offsetting arch 4. The height of the arch 4 will vary, but can be approximated as a function of a person's waist size and pant or leg length. The offsetting arch 4 is flexible. A thin metal rod or wire is preferred for the arch, but suitably strong plastics may be used. The arch could be formed from a continuous flexible loop, but the arch is preferred that has two distal end with each end of the arch fastened to the inner belt 1. Two offsetting arches 4 are provided, located on the inner belt 1 adjacent to each side of the zipper or center of the garment 6.

Figure 5:
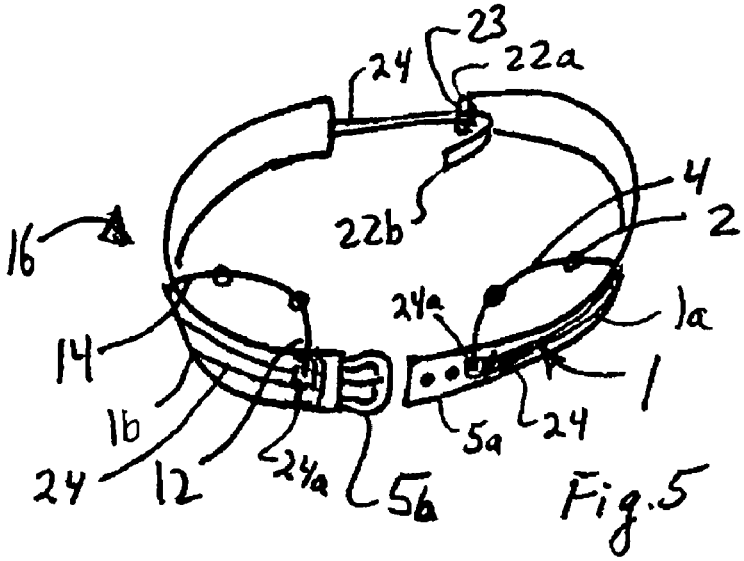
FIG. 5 is a perspective view of a inner belt with an adjustable back portion, apart from a garment, with two fasteners on an each arch and with the arches fastened to an outside of the inner belt.
Figure 6:
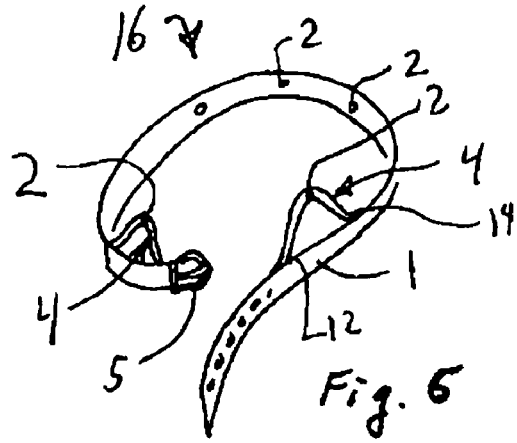
FIG. 6 is a perspective view of a inner belt with a non-adjustable back portion, apart from a garment and with one fastener on each arch, with the arches fastened to an inside of the inner belt.

In use, the fasteners 2 are connected to the inside of the back of the garment 6 (pants, skirt, etc,) by using a mating fastener, such as a mating buttonhole, mating snap, toggle loop, hooks, clamps such as those used in suspenders (FIG. 16), and other releasable fasteners now known. Preferably, the fasteners 2 are concealed from view by others, so external viewable clamps are not preferred. The arch 4 is also fastened to the inside of the garment, preferably using a releasable fastener 2, which is also preferably (but optionally) concealed from view by others. FIGS. 5-6 show one fastener 2 for each arch, while FIG. 1 shows two fasteners for each arch. Two fasteners are preferred, and more than two fasteners could be used for each arch, but less preferably. The inner belt 1 fits comfortably inside the garment 6 and supports the waistband 10 and waistline 3 of the garment 6 at the normal level by the fasteners 2 and arch 4, but without having to squeeze the stomach at the waistline 3 of the garment 6. The garment is held at its normal position around a person's waist internally by the inner belt 1 and arches 4, while the inner belt 1 is worn comfortably along the naturally formed body lines, without squeezing the stomach at the waistline 3 of the garment 6. In a sense, the bottom of the inner belt 1 rests against naturally occurring curves or creases in the body at the juncture of the thighs and stomach in order to support the garment internally, with the arches 4 provided to support the offset of the waistline 3 from the inner belt 1. The flexible arch 4 also allows deformation as a person sits down or bends over without pressing into the stomach. This construction allows a user to maintain the waistline 3 without having to tighten an external belt or garment fasteners so the garment 3 and/or external belt squeezes the user's stomach and causes discomfort and the inevitably causes the garment and/or belt to slide downward toward the user's crotch during use.

Figure 7:
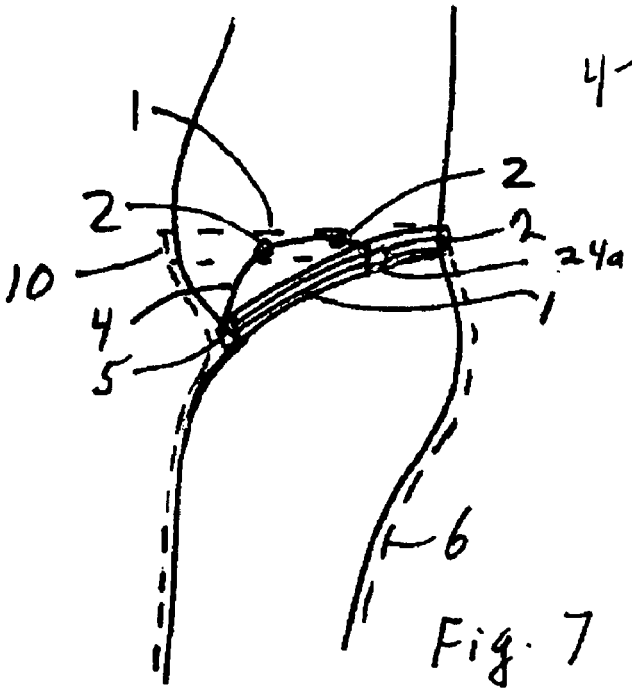
FIG. 7 is a side view of the inner belt of FIG. 1 on a person.

As used herein, the forward direction is the direction a person looks when looking straight forward. The rear direction is opposite, toward a person's back. Referring to FIGS. 1 and 7, the arch 4 has opposing ends fastened to the inner belt 1. The arch 4 preferably fastens to the outside of the belt but could fasten to the inside of the belt and that orientation is used in some of the Figures for ease of illustration. Outside refers to the side most distant from the user's body.

A front end 12 of the arch fastens to the inner belt 1 adjacent a person's crotch, near the zipper (if present) or the midline of a person's body. Advantageously the front end 12 fastens to the inner belt 1 at or near the lowest point below the user's stomach to provide a stable support. A rear end 14 of the arch 4 attaches to the belt adjacent a person's hip, preferably on the hip or slightly in front or behind the hip, which also provides a stable support. The arch 4 is usually straighter as it approaches the front end 12 because the inner belt 1 is further offset from the waistline 3. The arch 4 is usually more inclined as it approaches the rear end 14 because the waistline 3 is not offset from the belt as much. The arch 4 connects the garment 6 to the inside inner belt 1.

Figure 2:
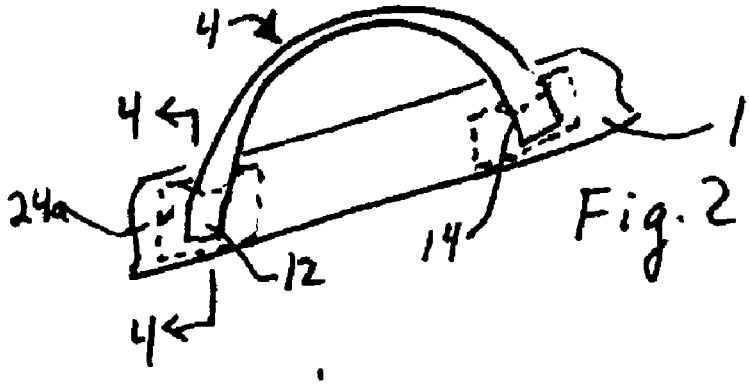
FIG. 2 is a front plan view of an arch used on the inner belt of FIG. 1.
Figure 4:
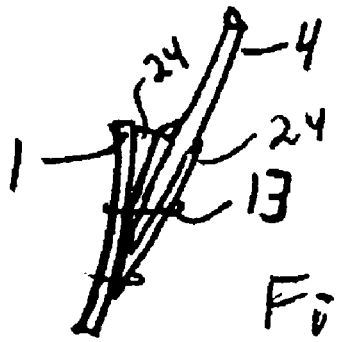
FIG. 4 is a partial sectional view taken along 4-4 of FIG. 2, showing the end of one arch attached to the inner belt.

Referring to FIGS. 1, 2 and 17, the front end 12 of the arch 4 is preferably, but optionally attached to the inner belt 1 using a rotatable or hinged connection which allows the front end 12 to rotate forward as a person bends forward. If the inner belt 1 is flexible, the front end 12 could be fastened directly to the belt by stitches, rivets, etc., and could be fastened adjacent a top and bottom of the belt. Stitches 13 are shown in FIGS. 4 and 17. If the inner belt 1 is stiff then the front end 12 could be fastened to the belt at a single point about which the front end 12 could rotate forward and backward. Further, the front end 12 could be formed with a hinged or narrower or weaker section in either the width or thickness of the arch, or both, in order to allow greater flexibility and bending when a person's stomach pushes forward on the arch 4. Given the present disclosure, a person skilled in the clothing and apparel art could devise other ways to rotatably fasten the front end 12 to the belt to allow rotation. The rear end 14 is fastened like the front end 12, but could be more stiffly fastened as it does not usually need to rotate as much as the front end 12. Rigid fastening of the arch 4 to a stiff inner belt 1 is possible, but less desirable since it may not be as comfortable to the user.

In addition to allowing some rotation of the arch 4, the fastener 2 connecting the inner belt 1 to the arch 4 also optionally accommodates forward and backward motion to allow easy expansion and contraction of the stomach as a user breathes or bends over or bends backward or twists etc. Thus, rigid connections are not desirable, while flexible connections are desirable.

The front and rear ends 12, 14 of the arch 4 are preferably, but optionally, stiffer than the middle portion of the arch. This can be achieved by changing the width or thickness of the arch. Advantageously the arch is formed of metal covered with fabric. The arch could be integrally molded of a plastic material such as polyethylene or polypropylene to help achieve this different flexibility, but this is not as desirable unless the plastic is strong. The more flexible center of the arch allows the top of the arch to flex downward as a person leans forward and reduces the pressure the arch exerts against the user's stomach as the user leans forward. The arch 4 is thus preferably designed to be flexible in all directions except it is stiff enough in the vertical direction to maintain the waistline 3 in the desired position.

Figure 8:
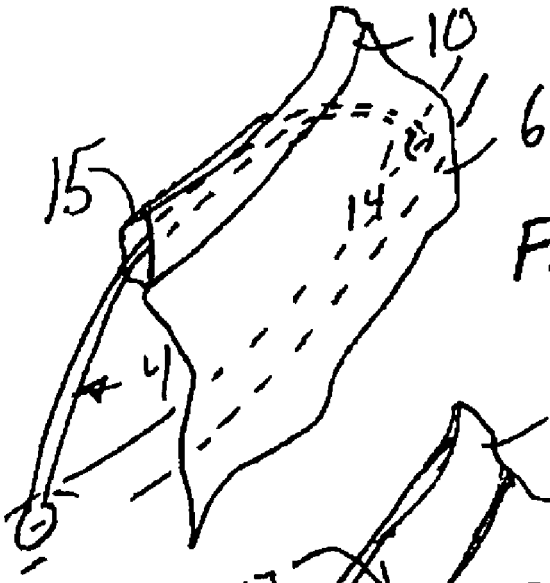
FIG. 8 is a perspective view of an arch in a pocket fastened to a waistband of a garment.
Figure 9:
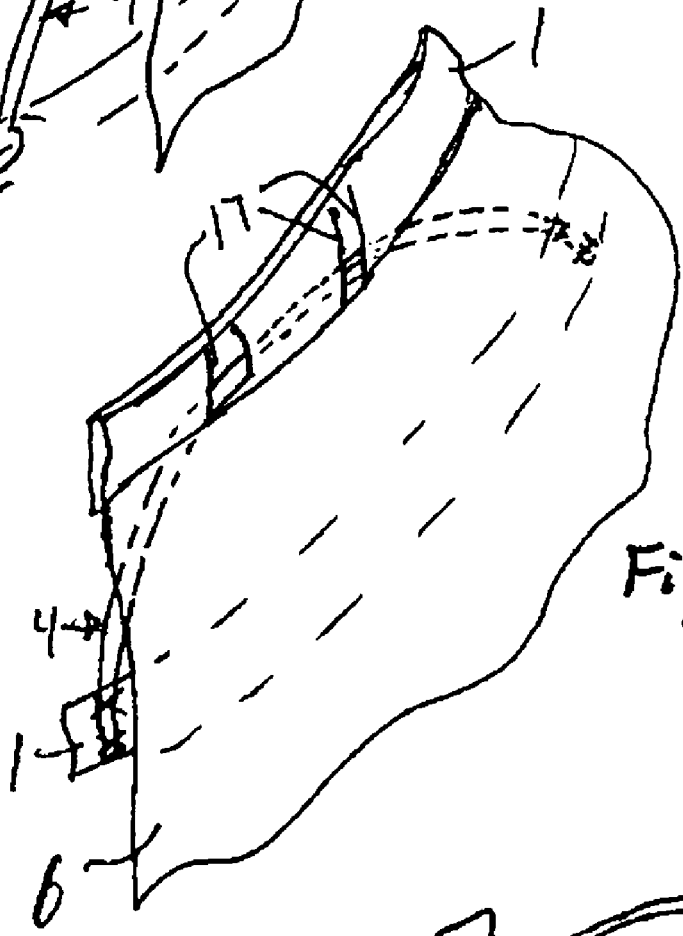
FIG. 9 is a perspective view of an arch passing through slits in a waistband of a garment.

Referring to FIGS. 1 and 7, the arch 4 is fastened to the waistband 10 of the garment 6 at two locations along a generally level or generally horizontal line, although the exact locations can vary with the position each user believes is most comfortable and attractive. Thus, in determining what constitutes generally level or generally horizontal, there is some visual leeway to accommodate user perception in what constitutes a suitable, horizontal position of the waistline. The connection is achieved by fasteners 2 located on the waistband 10 and arch 4, and preferably, but optionally, the fasteners on the waistband are located on the inside of the garment 6 and the inside of the waistband. Buttons or snaps fastened to the arch 4 could be used. Alternatively, referring to FIG. 8, the arch 4 could pass through a tubular pocket at the waistband much like a stay in the collar of a shirt. Further, as seen in FIG. 9, the arch 4 could pass through a pair of slits 17 in the waistband, or a loop in the waistband. The slits 17 are shown as visible on the outside of the garment 6, or they could be viewed only from the inside of the garment. Referring to FIG.

Figure 16:
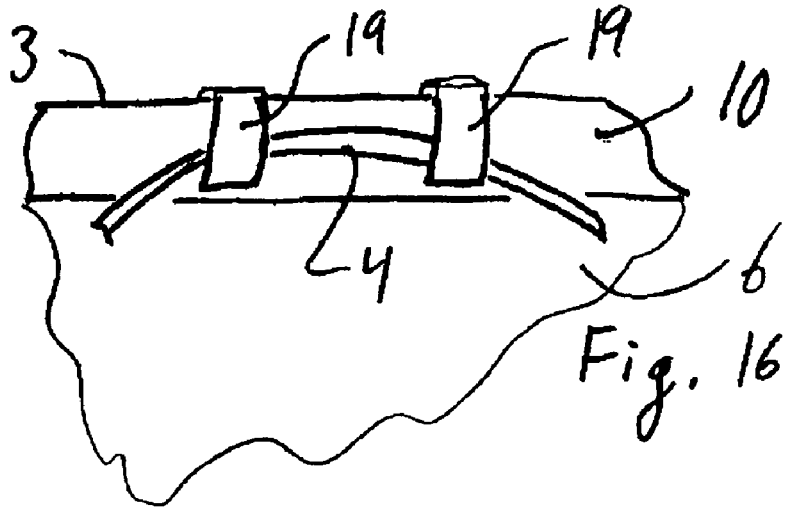
FIG. 16 is a partial perspective view of clamps fastening an arch to the inner belt at two locations.
Figure 20:
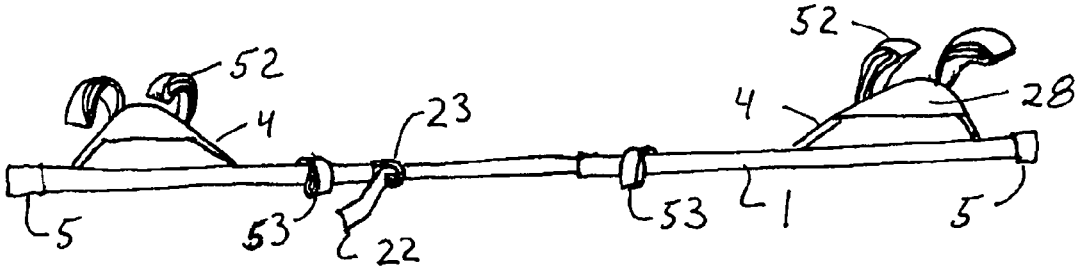
FIG. 20 is a plan view of a further embodiment of a mechanism for fastening an external belt to the arch and/or inner belt of FIG. 1.
Figure 21:
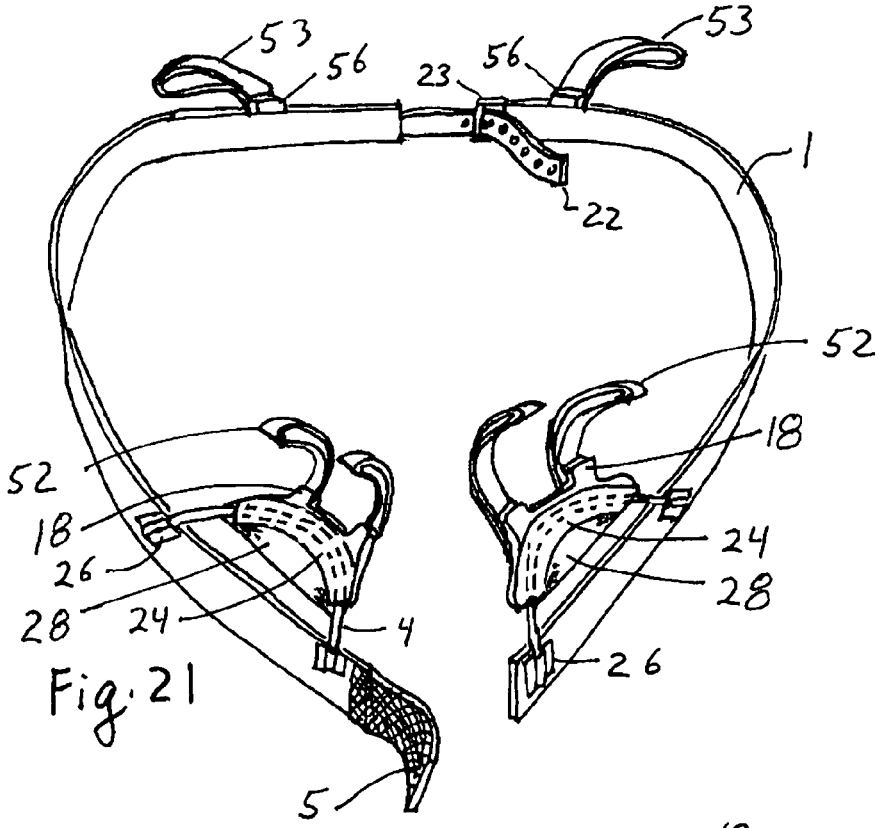
FIG. 21 is a perspective view of an inner belt similar to that of FIG. 20 with the length adjustment reversed and with no standoff tabs on the loops.

17, a piece of fabric is fastened to the arch and buttonholes 2 are formed therein to fasten with buttons on the garment 6. Referring to FIG. 16, clasps 19, of the type used on suspenders, can be clipped over the edge 3 of the waistband 10 to releasably hold the arch 4 to the garment 6. Various other releasable connections can be devised given the present disclosure. If desired, a curved pocket defining the shape of the arch could be sewn to the garment 6 and the arch inserted through the pocket and fastened to the belt. The arch and belt could be permanently affixed to the garment, but that may complicate dry-cleaning and pressing the garment. Thus, a removable arch and belt is preferred.

Figure 3:
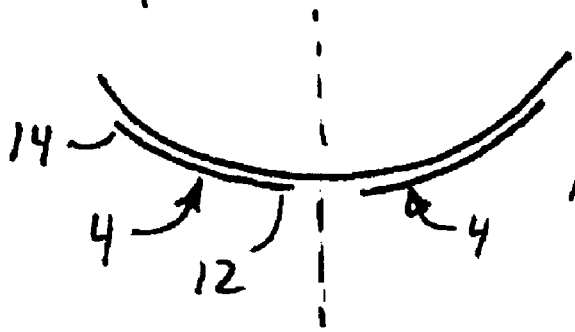
FIG. 3 is a top view of the arches of FIG. 1 conforming to the shape of a stomach.

Referring to FIGS. 3 and 4, the arch 4 is typically not in a flat plane during use, but curves to conform to the shape of a person's stomach. The distal ends 12, 14 of the arch 4 are optionally stronger to provide more vertical stiffness, and the middle portion of the arch 4 is more flexible in order to reduce pressure on the abutting stomach. The arch 4 is thus doubly curved, with a first curvature extending along a person's stomach in a generally horizontal direction to conform to the lateral portion of a person's stomach. The second curve of the arch 4 is along a vertical direction to conform to a person's stomach as it curves from the waistline downward toward a person's crotch. The arch 4 is preferably formed with this double curvature, but could also be formed flexible enough to take this preferred shape during use.

The arch 4 is typically not symmetric about a vertical line, especially when one arch is fastened to the garment 6 using two fasteners 2. The arch 4 is tilted since the front end 12 is lower than the rear end 14, according to the position of the inner belt 1 to which the arch is fastened. The top of each arch is preferably fairly flat so the arch can be fastened to the horizontal waistband of a garment. Alternatively described, each of the arches 4 preferably fasten to the garment 6 at two locations on the waistband 10, and the curve of the arch between those fastening locations is preferably small enough that the arch does not extend above the waistline 3. The arches 4 are located on the left and right sides of a user, and tilt toward each other or are inclined toward each other as best seen in FIG. 1. The two fasteners 2 that fasten the arch to the garment 6 are preferably in a generally horizontal line, but need not be so. Indeed, the arches 4 can be configured to allow the waistline 3 to be above or below the horizontal. Thus, the inner belt 1 defines the location of the ends 12, 14 of the arch and the connection 2 with the waistband 10 defines two more locations on the arch 4 for connecting the garment 6 to the arches and hence to the belt.

The connection between the waistband 10 and the arch 4 should be sturdy enough to allow the arch to support the waistband 10 and maintain the waistline 3 in position. Waistbands 10 are commonly formed if folded over material so they have additional thickness and stiffness. Preferably the waistband 10 has sufficient thickness or stiffness so the waistline 3 forms a uniform line and does not rise adjacent the connection with the arch and does not sag away from the connection with the arch. If the waistband 10 is not present, the arch 4 simply fastens directly to the garment 6.

Referring to FIGS. 6-7, the inner belt 1 optionally has fasteners 2 located at one or more locations along the user's back in order to fasten the belt to the garment 6 around the entire waistline 3 through the waistband 10. Preferably there is a fastener 2 on the rear side of each hip and one in the middle of the back of the garment 6, in order to ensure the belt 4 does not ride up into view if the user bends over, and to hold the belt in place when removing the garment.

Figure 11:
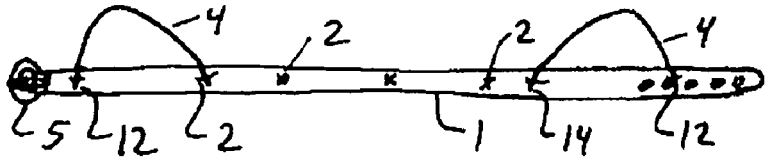
FIG. 11 is a plan view of the inner belt of FIG. 1.
Figure 12:
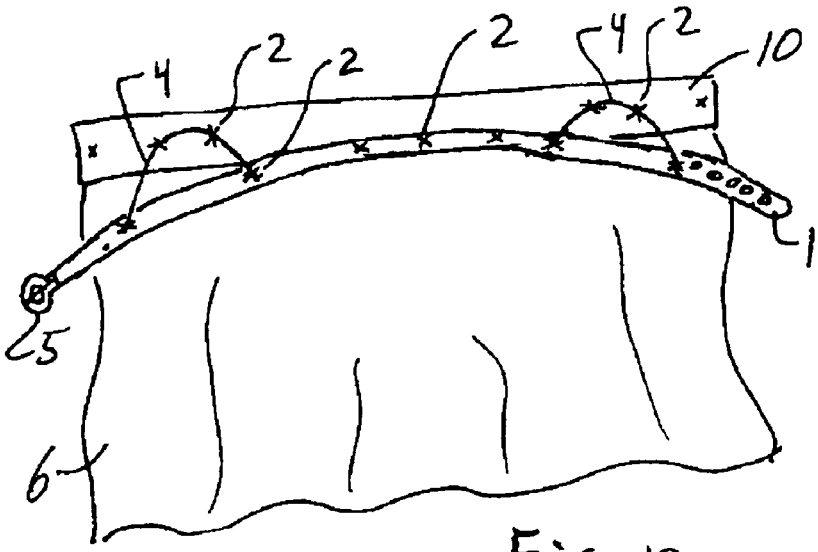
FIG. 12 is a plan view of an inner belt fastened to a skirt.
Figure 13:
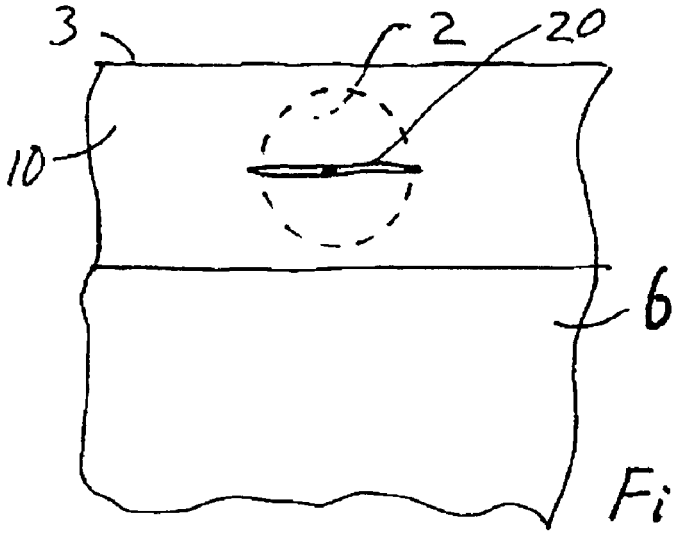
FIG. 13 is a plan view of a portion of a waistband showing a button hole for a fastener.
Figure 14:
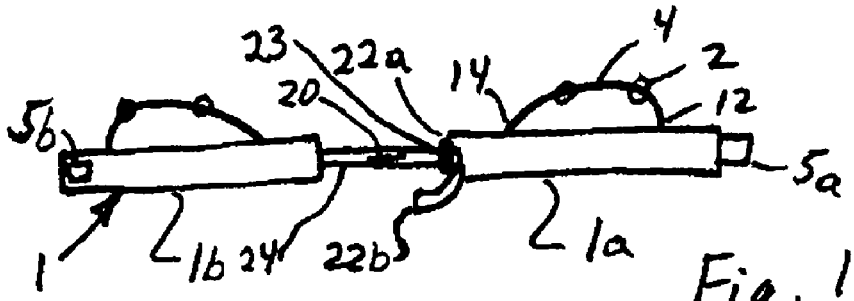
FIG. 14 is a plan view of the inside of the inner belt of FIG. 1 without a garment.
Figure 15:
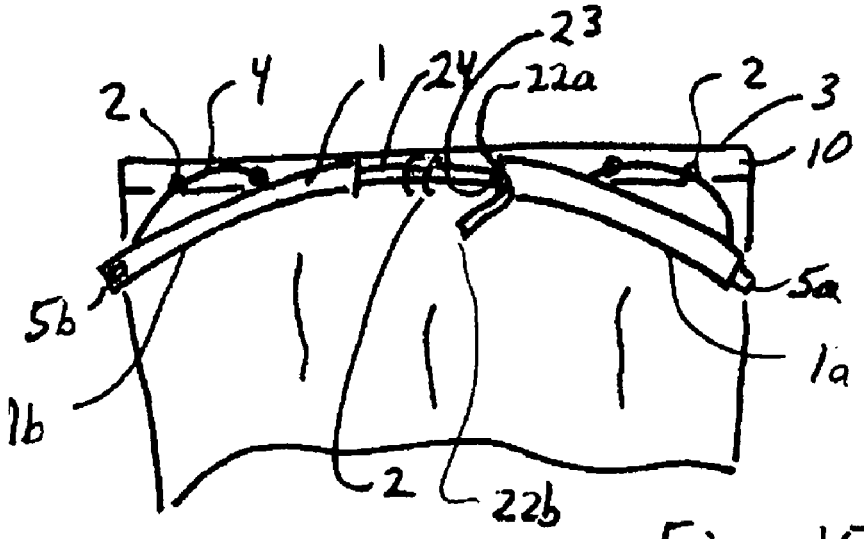
FIG. 15 is a plan view of the inside of the inner belt of FIG. 1 and the inside of the garment with the garment and inner belt laid flat.

Referring to FIGS. 5 and 6, the inner belt 1 can be of conventional configuration as in FIGS. 6 and 11-12, or can have an adjustable back as in FIGS. 5 and 14-15. The conventional configuration belt of FIGS. 6 and 11-12 may have fasteners 2 at various locations to connect to the garment 6 and will have arches 4, but cold otherwise be of conventional construction.

Referring to FIGS. 5 and 14-15, the inner belt 1 with an adjustable back portion is shown. The belt comprises two parts, 1*a* and 1*b* so the belt is adjustable adjacent a person's back. The buckle 5 could be a conventional adjustable buckle as in FIG. 5, but is preferably a two part buckle having one projecting part 5*a* the fits into and interlocks with a mating recess in the other part 5*b* as shown in FIGS. 14-15. Thus, any type of releasable mechanism could be used to releasably fasten the ends of the inner belt 1, just as any type of releasable mechanism could be used to releasably fasten the ends of the external belt 50 (FIG. 5). Each part 1*a*, 1*b* of the belt thus has a portion of the buckle 5*a*, 5*b* on one end, and an adjustable end 22*a*, 22*b* on the opposing end. In the depicted embodiment part 1*a* of the inner belt has a smaller width end adjacent the adjustable end 22*b*, and that smaller width portion could be an elastic material or a different material than the belt 1. The adjustable ends 22*a*, 22*b* are adjustably and releasably fastened together using any known mechanism 23. Such adjustable and releasable fastener mechanism 23 include buckles 5, and variations thereof, interlocking tabs with adjustable loops on the ends, a series of prongs and mating holes, and other adjustable fasteners described herein or known to those skilled in the clothing and apparel art.

An inner belt 1 with an adjustable back allows the location of the front end 12 of the arches 4 to maintain a constant location while the length of the belt is varied. Making the back of the inner belt 1 adjustable complicates fastening the back portion of the belt to the garment 6. FIG. 15 shows fastener 2 taking the form of one or more internal belt loops 25 fastened to the inside of waistband 10, with the belt threaded through the interior loops 25. FIG. 14 shows an elongated slit 20 in the belt portion 1*b* which can be passed over a button on the inside of the waistband 10. Mating snaps, toggles, and other fastening devices disclosed herein or known to those skilled in the clothing and apparel art can be used to fasten the inner belt 1 to the garment 6 along the back of the user and between the user's hips. More than one slit 20 could be used and more than one slit and fastener could be engaged to fasten the garment to the belt.

In use, the inner belt 1 sits slightly above the user's hips so that it rests on the hips and extends below the user's stomach and follows the juncture of the stomach with the thighs in order to provide a foundation to hold the garment 3 in position using the arches 4. This juncture is well defined when a person sits, and remains definable when a person stands or bends forward. The arches 4 connect to the inner belt 1 below the hips. The arch 4 spaces the waistline 3 above the user's hips in a generally horizontal position, or along a line considered desirable by the user. The shape and size of the arch 4 is varied according to the size of a person's stomach (e.g., the amount the stomach protrudes) and the desired location of the waistline. The inner belt 1 and arch 4 combine to provide a positioner 16 (FIG. 5) that holds the waistline 3 in a desired position, using an internal inner belt 1 that comfortable conforms to the user's natural body formation along the juncture of the thighs and stomach. The positioner 16 inhibits the waistline 3 of the garment 6 from sliding down the stomach, and varying the arch 4 can vary the level of the waistline 3 to a desired location. For persons with a protruding stomach the waistline 3 is often preferred to be horizontal and slightly above the hips. In contrast, some youths may prefer the waistline 3 to be maintained closer to the crotch, whether horizontal or not.

The positioner 16 gives a very comfortable fit around the user's waist. The inner belt 1 is adjustable using an adjustable strap at the back section of the belt. This allows full adjustments without changing the relative position of the arches with the garment. The belt need not be tightened to compress against the user's stomach. The positioner 16 rests against the outside of a user's shirt to hold the shirttails in place while the waistband 10 rests comfortably around the user's waistline, without squeezing the stomach uncomfortably. As desired, some or the entire arch could be covered with a material that will enhance the shirt holding ability, such as a slightly rough, gripping material that will more readily cling to the shirt. A construction using a metal arch covered with fabric such as thick cotton or polyester. A curved metal rod of uniform cross section is believed suitable, with a circular cross-section being preferred for such a curved member. One or more of the flexible arch 4, flexible inner belt 1, or the rotatable connection 2 with the inner belt 1, allow comfortable movement in any direction without binding or squeezing the user's stomach.

Different sized and shaped arches may be to adjust for a person's waistline and stomach size, and also to adjust somewhat for a person's height. Because the arch is fastened at only a few locations, removal and replacement is easily achieved. The positioner 16 is light and does not put pressure on the user's body, and the small amount of pressure that is applied is applied along the naturally occurring fold lines between a person's thighs and stomach. Indeed, as a person sits down, the thighs and stomach may clamp the positioner 16 in place. The positioner 16 is opened only when the garment is opened or removed. The positioner 16 is opened by disconnecting the distal ends of the inner belt 1, typically by unbuckling buckle 5 located between the arches 4. Opening the positioner 16 is useful to undo a zipper down the front of a pair of pants. But if the garment has no front zipper as in some ladies' skirts, then the belt may be made so it does not open.

If desired, the arch 4 could be provided with tabs to make it easier to connect the garment 6 to the arch using fasteners 2. For example, as seen in FIG. 9, a tab 18 could have a buttonhole in it to allow a button on the inside of the waistband 10 of garment 6 to fasten to the tab 18 and arch 4. Again, other releasable connectors could be used with removable arches 4, such as snaps, toggles, hook-and-loop, etc.

The above description uses two arches 4, but more arches could be used. For most normally sized persons, two arches 4 are sufficient.

As best seen in FIGS. 1, 5-6 and 11, a special inner belt 1 is used which has a front end 12 of a first arch 4 fastened at or very near to the buckle 5, or other releasable connector. The other, tail end of the inner belt 1 typically has the front end 12 of the second arch 4 fastened at a greater distance from the end of the belt because the belt is adjustable. The inner belt 1 may have releasable fasteners 2 at various locations along the length of the belt to allow the position of the arches 4 to be varied. The inner belt 1 may have the arches 4 permanently fastened to the belt. Rivets, stitches, etc. are among the various ways to permanently fasten the arches to the belt. The belt may be a two-piece belt with an adjustable back (FIGS. 5 and 14-15).

Referring to FIGS. 1, 7, 12 and 15, the garment 6 preferably has a waistband 10 stiff enough to support the waistline in a desired position, which is typically level or horizontal, when connected to each of the arches 4 at the desired number of locations, typically at one or two locations per arch. The garment 6 also preferably has fasteners 2 at locations that correspond to the middle of the user's back and rearward of the hips to ensure the inner belt 1 does not ride up above the waistline 1. The garment 6 has fasteners 2 at locations corresponding to the position of the arches 4. The garment 6 can be pants, skirts, dresses, or other garments work over the lower portion of the body that are fastened around the user's waist. The arches 4 are preferably removably fastened to the garment 6 using fasteners 2, but the arches could be permanently fastened to the garment, in which case the arches could be either removably fastened to the inner belt 1 at ends 12, 14, or the arches could be permanently fastened to the belt. Thus, the inner belt 1 and arches 4 could be permanently fastened to the garment. For custom tailored clothing, the inner belt 1 could have a fixed length and be fastened permanently to the clothing.

The arch 4 is preferably a continuously curved, flexible member. The arch 4 could be made in straight line segments, but that is not preferred because the corners are likely to press noticeably against the user's stomach and the corners are likely to kink and break. The arches 4 are thus preferably continuously curved between the connections to the inner belt 1, without any sharp corners. The rear ends 14 on the left and right arches 4 preferably fasten to the inner belt 1 near the user's hips, and preferably just in front of the users' hips. The front ends 12 on the left and right arches 4 preferably fasten to the belt above the user's crotch, and advantageously high enough above the crotch that a male user could urinate without undoing the inner belt 1. While the specific dimensions and locations of the arches 4 will vary with a person's stomach and physique, for many people the top of the arches will be about 4-6 inches away from the center plane of a person's body, where the plane extends from the front to the back through the middle of a person's body. The front end 12 for many users will be located about two inches from that center plane. Preferably, looking at the face and front body of an adult person wearing the inner belt 1, the distance between the front ends 12 of the two adjacent arches is about four inches and the distance between the fasteners 2 on the each of the front ends 12 of the arches 4 is about seven inches.

Referring to FIG. 12-13, 15 and 17, the arches 4 are preferably, but optionally fastened to the garment 6 by buttons 2 placed into a pocket in the waistband 10 through a generally horizontal slit 20. The slits 20 are advantageously formed in a piece of material 21 (FIG. 13) which is then fastened to the waistband 10, preferably by sewing or clipping it to the waistband. That allows the slit 20 to take the form of a reinforced buttonhole with the piece of material containing the buttonhole forming a pocket between the piece of material and the waistband 10 with the button 2 received and held in that pocket. The buttons 2 are preferably, but optionally, about as large in diameter as the width of the waistband 10 so that the buttons help hold the entire width of the waistband in position to reduce sagging between the various connections to the inner belt 1. The horizontal slit 20 (FIG. 13) allows the fastener 2 to move laterally along the waistband 10 to accommodate movement of the user while still supporting the waistband 10 and waistline 3 through the arch 4 connected to the button 2. About 0.5 inches of lateral movement of fasteners 2 that connect the arches to the garment 6, is believed suitable for most uses. A piece of stiffer material 21, such as a plastic part with rounded corners could be permanently placed in the waistband, with a snap to releasably connect to the arch, and with a slit 20 to allow movement of the snap and plastic insert along the waistband. Indeed, a snap fastener at the center of the depicted button 2 that is accessible through slit 20 would provide such a connection. Other movable and releasable fasteners 2 can be devised given the present disclosure, including passing the inner belt 1 through loops 25 as in FIG. 15.

There is thus provided means comprising a positioner 16 comprising a inner belt 1 with a two flexible offsets 4 located near opposing distal ends of the belt, and fasteners 2 that fasten the garment 6 to the arch inside the garment for supporting the waistline 3 of the garment at a normal level while that waistline is offset from the belt by the arches 4.

Referring to FIGS. 4 and 17, a preferred construction is shown having a flexible inner belt 1 of a relatively thick woven fabric, of the type used on "Army belts." This thicker, woven fabric is relatively flexible, or at least it deforms more readily if a constant deformation force is applied as by the distal end of the arch 4. The thick woven fabric of inner belt 1 provides a cushion against the body of the user. The arch 4 is optionally enclosed in fabric, such as thick cotton stitched around the metallic arch, with the ends 12, 14 of the arch inserted into pockets formed by a strip of material 24*a* forming a little pocket 26 that receives one end of the arch. A short strip of nylon is suitable for the material 24*a*. The strip of material 24*a* is fastened to the belt by stitches 13, but could be riveted, glued, or fastened by other ways described herein or known to one skilled in the clothing and apparel art.

Referring to FIG. 17, a strip of material 28 is sewn to opposing legs of the arch 4 and fasteners 2 are connected to or formed in that piece of material. In the illustrated embodiment button holes 2 are provided and located to fasten to mating buttons on the inside of the waistband 10 of the garment 6. Again, various fasteners can be connected to the material 26 as described herein or as known to a person skilled in the clothing and apparel art. Further, while FIG. 17 shows both buttons 2 connected to the arch 4 and button holes 2 connected to the material 26, both are considered connected to the arch 4 and one or the other could be provided, or both could be provided, or any combination thereof Preferably, but optionally, the material 24*a* forms an elongated strip 24 that extends along the entire length of inner belt 1. In FIGS. 14-15, the elongated strip of material 24 can form part of belt portion 1*b* which threads through a clasp to form an adjustable portion at the back of the user, or in the middle of the belt. In this configuration the elongated strip of 24 is of Nylon and is less stretchable than the woven material of underlying belt portion 1. There is thus provided an inner belt 1 having two portions 1*a*, 1*b* joined at a middle of the belt. Each belt portion 1*a*, 1*b* has an arch 4 fastened thereto. Each belt portion 1*a*, 1*b* preferably, but optionally, has a softer portion 1 located on the side of the belt toward the user and a strengthening portion 24 located on the side of the belt away from the user. The elongated strengthening portion 24 can form a portion of the connection between ends 22*a*, 22*b* of the belt.

Still referring to FIG. 17, the material 24 locally stiffens the segment of the inner belt 1 that holds the ends of the arch 4. The arch 4 can flex in along the vertical Y axis as a person bends forward against the arch, and the apex of the arch between the buttons 2 can move relative to the inner belt 1 which remains stable. Further, as a person bends forward the arch 4 can rotate about the X axis at the juncture of the arch 4 with the inner belt 1 so the apex of the arch moves in and out of the X-Y plane while the ends of the arch remain stable at the belt, as partially shown in FIG. 4. Likewise, the ends of the arch 4 can move along the Z axis relative to the apex of the arch between the buttons 2 in order to curve around a user's stomach as shown in FIG. 3.

The strips 24 fastened to the inner belt 1 at the ends of the arch 4 provide a stable base for the arch 4, allowing the arch to rotate and deform while the ends of the arch remain in essentially the same location, but may rotate as the arch tilts or deforms. The connection of the ends of the arch 4 to the inner belt 1 thus restrains translation of the two opposing ends of the arch relative to the inner belt 1, but permits rotation in at least the Z axis so the arch apex can rotate.

The forces on the arch 4 are believed to come from two main sources, the first being the weight of the garment 6 passing through the fasteners 2 to the arch 4 and through the arch to the inner belt 1 and thus to the user. The second source of forces is believed to be the force exerted by the user's body on the arch 4, and that force is believed to primarily come from the user's stomach, with the force varying depending with movement of the stomach, as for example when the user bends forward, sideways or backwards.

The connection of the ends of the arches 4 to the inner belt 1 also cushion the forces exerted on each arch and pass those forces along a length of the belt placed along the creases or junctures between the user's thighs and stomach. Since the force exerted on the arches 4 is diffused along a relatively long length of the belt, the force is less, the smaller force is less noticeable and the user's comfort is increased. Moreover, as the user moves the inner belt 1 does not tighten with movement of the user's stomach as in the prior art because the inner belt 1 rests against the body creases at the juncture of the stomach and thighs, and also rests on the user's hips. Further, it is believed that as the size of a user's stomach increases and protrudes more, the belt begins to be squeezed or clamped between the user's thighs and stomach, and this squeezing or clamping of the inner belt 1 further distributes any force from the arches 4 and inner belt 1 over a greater area, further lessening the force and increasing the perceived comfort.

Thus, when the arch 4 is described as flexible in the vertical direction, the flexibility refers to the ability of the arch 4 to move as described when fastened to the inner belt 1. When the arch 4 is described as rotating about the length of the inner belt 1, the rotation refers to the ability of the arch 4 to rotate about the X axis (FIG. 17) as described when the ends of the arch are fastened to the inner belt 1.

In a preferred embodiment, the ends of the arches can be pulled out of the pockets 26 formed in the inner belt 1 by strips of material 24. If the garment 6 is provided with belt loops on the inside of the garment on opposing sides of the crotch or zipper, the user could thread the buckle parts 5*a*, 5*b* through these loops and use the inner belt 1 as an internal, concealed belt. This could be useful when the user is to remain seated for long periods of time, as on transcontinental flights which can last from 10-15 hours, or more.

The inner belt 1 is greatly preferred to be worn inside the garment 6 and concealed from view during use. But the inner belt 1 could be worn outside the garment 6. Moreover, while the inner belt 1 maintains the position of the garment waistline 3 at the desired location (horizontal or otherwise). Further, even though an internal inner belt 1 maintains the waistline 3 and supports the garment 6 on the user's body, external belt loops and an external belt can be used in order to maintain conventional appearances. Indeed, a user with a pronounced stomach but wearing an external belt at a horizontal position maintained by internal, concealed inner belt 1 and arches 4, is believed to appear thinner than the user actually is. If an external belt is used, it is preferably, but optionally, thin, slightly elastic and light weight.

The inner belt 1 and arches 4 thus provide means for maintaining the waistline 3 of a garment 6 in a desired location on a user's body. The arches 4 provide means for varying the position of the waistline 3 relative to the inner belt 1. The adjustable buckle 5 accommodates variations in waist size. The adjustable rear portions 22*a*, 22*b* joined by the releasable mechanism or buckle 23 also accommodate variations in waist size but without altering the relative position of the arches 4. The various mechanisms such as buckles 5, 23 provide adjustable means for joining ends of the inner belt 1.

The inner belt 1 provides a very comfortable way to support the garment 6 while maintaining the waistline 3 at a desired location. The belt 3 is preferably lightweight, weighing about ⅓ the weight of a leather belt of comparable width.

Referring to FIGS. 18-19, the inner belt 1 is preferably inside the garment 6 and not normally visible to others. A normal belt 30 can be worn outside the garment 6 to give the appearance of a normal belt and garment. If belt loops (e.g., loops 25) are provided in the garment the belt 30 will be held by those loops. But it is advantageous to keep the belt level with the waistline 3 of the garment 6. To do so, a piece of material 21 can be fastened to the belt 30, preferably on the inside of the belt, to form a pocket 26. Stitches 13 are preferably used to fasten the material 21 to the belt 30, but rivets, adhesives or other fastening mechanisms could be used. The piece of material 21 is preferably fastened to the belt 30 along three sides, around the opposing ends and bottom but not at the top, so an open pocket 26 is formed on the inside of the belt 30. A clasp 19 can fit inside the pocket 26 to clamp the pocket (and thus the belt 30) to the garment 6, thus maintaining the belt 30 in alignment with the waistline 3 of the garment. Instead of a clasp 19, the piece of material 21 fastened to the external belt 30 could have a buttonhole as described in FIG. 13, so that a button fastened to the waistband on the outside of the garment 6 could be fastened to the external belt 30. By forming a pocket 26 on the inside of the belt 30, the pocket and clasp 19 are concealed from view, although a top portion of the clasp may be visible. A button connecting the garment to the pocket 26 formed by piece of material 21 would be concealed from view. There is also provided a means for fastening an external belt 30 to the garment 6 to maintain the belt 30 in a desired alignment with the waistline 3 of the garment.

Further, the arch 4 could also be held by the clasp 19 in order to fasten the interior inner belt 1 to the garment 6, as shown in FIG. 19. There is thus provided further means for fastening the inner belt 1 to the garment.

Referring to FIG. 15, the inner belt 1 is preferably fastened to the garment 6 at a location along the user's back by passing the strip of material 24 through belt loops 25, although any known ways of releasably fastening the parts can be used. But as seen in the figure the wide portion of inner belt 1 has an end 22*c*. Ends 22*a*, 22*c* could be fastened directly to the garment 6, by buttons, snaps, toggles, or other releasable connections. Thus, button holes 20 are shown in FIG. 14 in the ends 22*a*, 22*c*, for fastening with aligned buttons (not shown) on the garment 6. Further, the ends 22*a*, 22*c* could be permanently fastened to the garment 6, as for example by sewing or rivets or other fastening mechanisms used in the apparel industry.

Referring to FIGS. 20-25, another mechanism is disclosed for fastening the inner belt 1 and/or arch 4 to the garment 6, using external belt 50. At last one, and preferably a plurality of first loops 52 are connected directly or indirectly to each arch 4. Each first loop 52 is long enough so it can extend from inside the garment 6, over the waistline 3, and along the external waistband 10 a distance sufficient so that an external belt 50 can be threaded along its normal path through the external belt loops 60 found on the garment 6, and also threaded through the loop(s) 52. At least one, and preferably a plurality of such loops are also fastened to the back of the internal belt 1 so the external belt 50 can thread through those back loops or second loops 53 as well when the outer belt 50 is threaded along its normal path through external belt loops 60. The user's external belt 50 can thus be used to connect to the arch 4 and/or belt 1 to support the garment 6.

Referring to FIG. 20-25, in a preferred embodiment, the first and second loops 52, 53 have a portion forming an opening and also and optionally have a free end 54. The loops 52, 53 can be formed by taking an elongated strip of material with first and second ends and sewing the second end to the strip of material inward between the first and second ends to form the loops, with the portion between the loop and the first end forming the free end 54. The free end 54 is fastened to the inner belt 1 by any suitable means, including sewing, riveting, gluing, hook and loop fasteners, and other known fastening means or means developed in the future. Preferably, the free end 54 is sewn to the inner belt 1 or to a support connected to the inner belt 1.

Advantageously the inner belt 1 is stiffened at the location where the loops 52, 53 are fastened. Referring initially to the second loops 52 at the back of the garment 6 and inner belt 1, this localized stiffening is preferably achieved by fastening an elongated stiffener 56 to a portion of the loop 52, 53. This can be achieved by placing the free end 54 of the loop 52, 53 between the belt 1 and the stiffener 56 and fastening those parts together using mechanical fasteners or other fasteners such as gluing etc. Preferably the parts are sewn together by stitches 13 as in FIG. 23*a*. A stiffener about 0.4 inches (1 cm) wide, about 1.5 inches (3.5 cm) long, and about 0.1 inches (0.3 cm) thick, made of stiff fiberboard or of fiberboard composite, is believed suitable. A thin plastic can be used if it could be sewn without fracturing with repeated use. A stiff shoe leather or piece of elastomer or rubber could also be used, as could a variety of other materials.

Figure 23A:
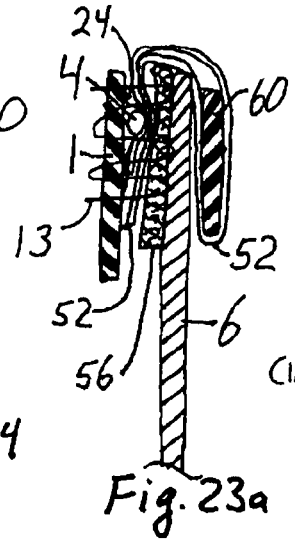
FIGS. 23*a*, 23*b* are sectional views taken along Section 23-23 of FIG. 22 showing two different embodiments with different arch locations.
Figure 23B:
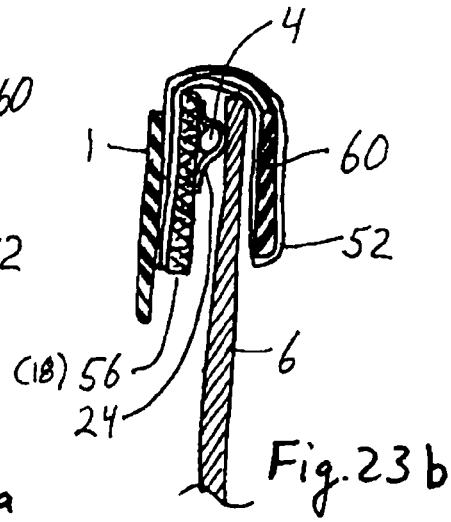
Figure 25:
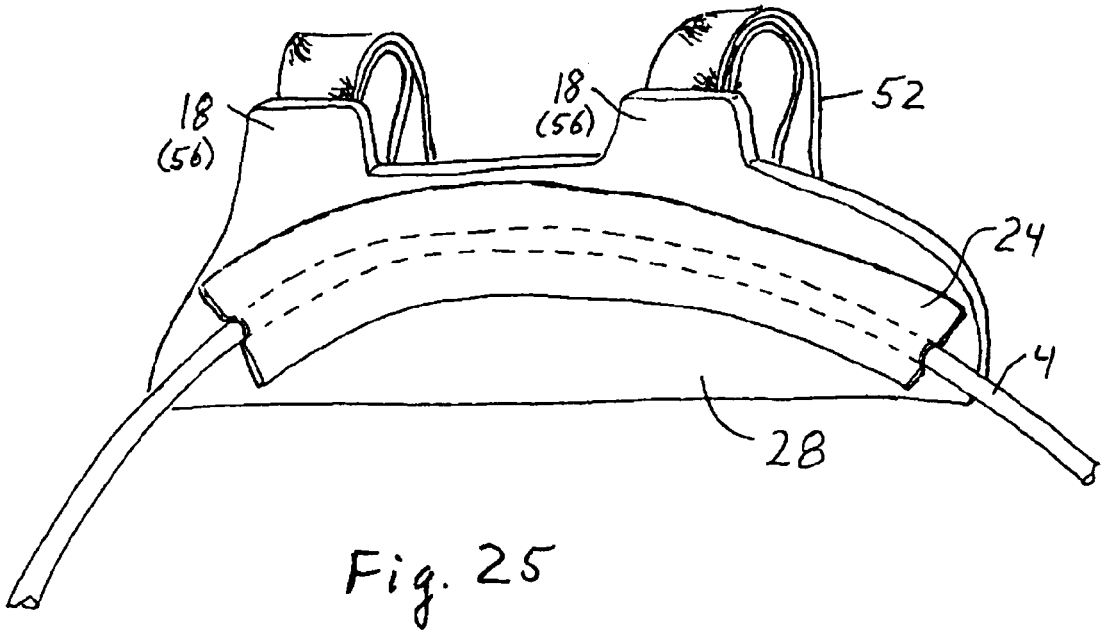
FIG. 25 is a perspective view of a segment of the fastening mechanism of FIG. 21.

The loop 52, 53 (or 62) is preferably fastened directly to the belt 1 and located between the inner belt 1 and stiffener 56 as shown in FIGS. 23*a*, 23*b*. But the loops could be on the outer side of the stiffener 56 adjacent the garment 6 during use as is loop 62 in FIG. 26. The arch 4 is also preferably fastened directly to the inner belt 1, between the inner belt 1 and the stiffener 56 as in FIG. 23*a*, but could be fastened to the between the stiffener 56 and the garment 6 as in FIG. 23*b*. Other arrangements of the parts could also be used.

The top of the loop 52, 53 and stiffener 56 advantageously extend to or slightly above the waistline 3, with the loop 52, 53 being long enough to lay along the outer waistband 10 so the user's external belt can pass through the loop. The stiffener 56 is advantageously configured and made of a material such that it is strong enough to prevent the loop 52, 53 from pulling down the waistline 3 at the location of the loop. The stiffeners 56 could be omitted, but then the waistline can be pulled down at the location of each loop 52, 53. Thus, the stiffener 56 is configures so that it extends above the waistline far enough so the waistline is not appreciably pulled down during use with the external belt 50 is used. Thus, the stiffener 56 keeps the top of the loop 52, 53 above the waistline 3 during use, with the external belt 50 abutting the bottom of the loop. Top refers to the upward or skyward direction as a person is standing, and bottom refers to the downward, earthward direct as a person is standing. Preferably, there is one loop 52, 53 on opposing sides of the adjustable member fastener 22*a*.

Figure 10:
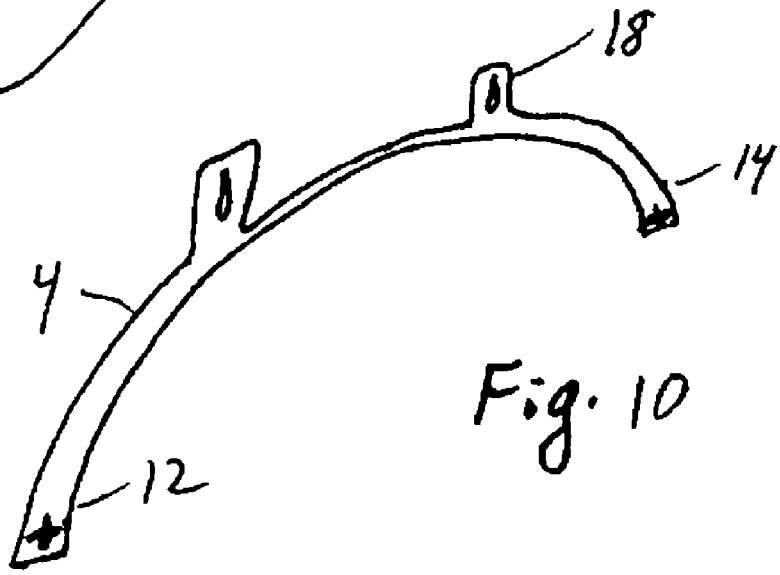
FIG. 10 is a view of an arch having tabs for connecting to a garment.

A similar construction is advantageously used in connecting the external belt 50 at the front of the garment. An arch 4 as shown in FIG. 10 can have one or more tabs 18, with a loop 52 fastened to one of the tabs 18, and with the tab 18 configured to place the top of the loop 52 above the waistline 3 during use. Alternatively, a stiffener 56 can be fastened to the inner belt 1, fastened directly to the arch 4 and have a loop 52 fastened to the top of the stiffener 56 as previously described. The stiffeners 56 help support the weight of the external belt 50 which in turn supports the weight of the garment 6.

Preferably though, as shown in FIGS. 20-25, a small sheet of material 26*a* is fastened to each arch 4. The sheet of stiffening material 26*a* extends across the top of the arch 4 and optionally has at least one, and preferably has two, spaced apart tabs 18*b*. A loop 52 is fastened to each tab 18*b*. The stiffening material 26*a* is stiff enough in the vertical direction that the loops 52 do not pull the waistline 3 downward, yet flexible in the other two directions that they are comfortable for the user, especially when the user bends over. A sheet of material about 0.1 inches thick, made of a stiff leather or leather and elastomeric composite, is believed suitable. The sheet of material 26*a* need not be continuous but may have holes or openings in it. The arch 4 is preferably fastened to the stiffening material 26*a* by a strip of material 26 placed over the arch 4 and sewn to the material 26*a* by stitching 13 or otherwise fastened to the material 26*a*. The tabs 18*b* extend above the arch 4 so the arch does not show above the waistline 3. The sheet of material 26*a* and tabs 18*b* are preferably stiff enough to support the weight of the garment 6 while not visibly distorting the waistline 3 when the external belt 50 is threaded through the loops 52 fastened to the tabs 18*b* and also threaded through the external belt loops 60 typically found on a garment. Alternatively, localized stiffeners 56 can be fastened to the tabs 18*b* and arch and/or inner belt 1 to support the top of the loops 52 above the waistline 3 during use.

During use, the external belt 50 is threaded through the loops 52 directly or indirectly connected to one of the arches 4 and also threaded through the normal external belt loops 60 found on garments. The weight of the garment 6 pulls the external belt 50 downward against the bottom of loops 52, while the top of the belt loops 60 on the outside of the garment normally abut the top of the external belt 50. The loops 52 are fastened to one of the arches 4 to support the external belt 50. Preferably, the tabs 18*b* and/or stiffeners 56 keep the top of the loops 52 above the waistline 3 so the waistline is not visually distorted and so the top of the arch does not extend above the waistline 3. But again the tabs 18*b* are optional. The arches 4, tabs 18*b* and sheet of material 26*a* transfer the weight of the external belt 50 and garment 6 to the inner belt 1, and in varying degrees support that weight off the inner belt 1 and maintain the position of the loops 52 relative to the inner belt 1.

There are preferably two tabs 18*b* on each arch 4, with the tabs spaced about 2-2.5 inches (5-7 cm) apart measured center to center when the tabs 18*b* are about 0.5 inches wide, and measured from inner-edge to inner edge when the tabs 18*b* are wider. This spacing allows one of the two loops 52 connected to an arch 4 to fit close to the belt loops on most normal pants. It is desirable to have a loop 52 close to the normal, external belt loop 60 on a garment. The design considerations and construction of second loops 53 are preferably the same as loop 52 and is thus not repeated.

There is thus advantageously provided an apparatus for using an external belt 50 to support the weight of a garment 6 along a substantially straight waistline, and to use an inner belt 1 with arches 4, and loops 52 fastened to the inner belt 1 and/or arches 4, to support the external belt 50.

There is also advantageously provided a method of using external belt 50 passing through external belt loops 60 to support the weight of a garment 6, and passing that external belt 50 through loops 52, 53 connected to and supported by inner belt 1 so the weight of the garment is carried by the inner belt. The inner belt 1 conforms to the body curves of the stomach adjacent the juncture with the user's thighs, while the outer belt 1 conforms to a substantially level waistline 3. The arches 4, stiffeners 56, and tabs 18*b* are interposed between the exterior belt 50 and the inner belt 1 to support the weight of the external belt 50 and garment 6 off the inner belt 1 and to maintain the position of the loops 52, 53 relative to the inner belt.

In broad terms, the inner belt 1 is placed along the contoured juncture of the stomach and thighs at the front of a user's body, and above the user's hips at the back of the user's body. The inner belt 1 is flexible and comfortable. Offsets, in the form of arches 4 or localized stiffeners 56 offset the top position of loops 52, 53 above the inner belt to define the position of the waistline 3 of a garment 6. The offsets, in the form of arches 4 and local stiffeners 56 flex to conform to the user's stomach and movement, but provide enough vertical stiffness to support those loops 52, 53 and transfer the weight of the garment 6 to the inner belt 1. The external or outer belt 50 thus carries the weight of the garment through the normal garment belt loops 60, and the offset belt loops 52 carry the weight of the outer belt 50 while the offsets in the form of arches 4 and stiffeners 56 transmit the weight of the garment 6 and outer belt 50 to the inner belt 1. The waistline 3 is thus supported by the inner belt 1, which is concealed from view and which more comfortably supports the garment weight because the inner belt 1 follows the body contours along the juncture of the stomach and thighs. The waistline 3 can maintain a level or straight position as the user moves since the user's movement distorts the inner belt 1, leaving the outer belt 50 relatively unaffected. By supporting the weight of the garment 6 on the inner belt 1 which is concealed from view by the garment 6, the outer belt 60 and waistline 3 of the garment 6 can be held at any desired position and thereby avoid the unsightly appearance of a stomach overhanging the garment's waistline. A level waistline 3 makes the person look slimmer. Further, because the waistline 3 is supported by the concealed, inner belt 1, the waistline position relative to the inner belt 1 is maintained as the persons' body moves and bends. This allows movement of the person's body and also allows adjustment of the waistline position with little restriction from the user's stomach size and with little or no distortion of the stomach.

Figure 26:
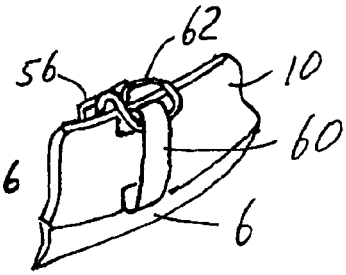
FIG. 26 is a perspective view of a further embodiment of a belt loop fastening mechanism.
Figure 22:
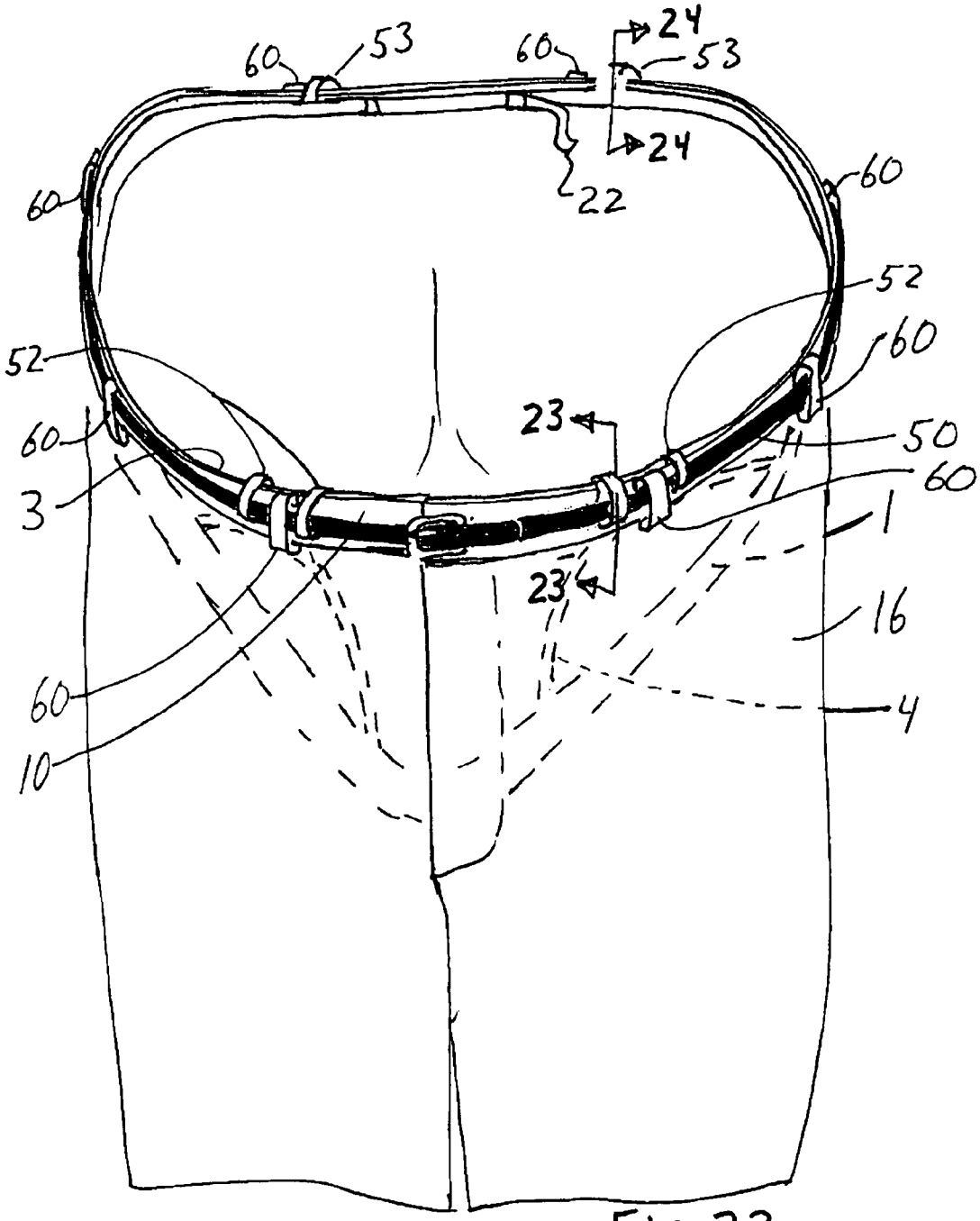
FIG. 22 is a perspective view of an inner belt similar to that of FIG. 20 or 21 in use.
Figure 24:
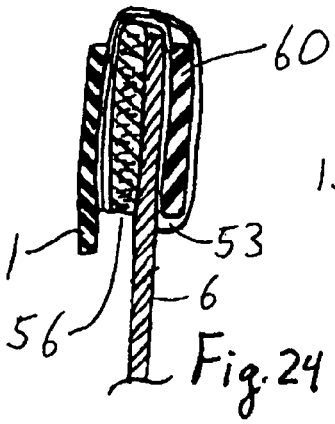
FIG. 24 is a sectional view taken along Section 24-24 of FIG. 22.

Referring to FIG. 26, a further mechanism for fastening to the outer belt 60 is shown in which a loop 62 fastened to the inner belt 1 and/or stiffener 56 passes through an external belt loop 60 of the garment 6 to support the garment. The loop 60 preferably has one end permanently fastened to belt 1 or stiffener 56, and the other end releasably fastened to the belt 1 or stiffener 56 by fastener 2. Snaps, hook ands loop fasteners, buttons, clasps, forming knots with the free end, fitting enlarged ends into smaller retention slots, or other releasable fastening mechanisms as previously described are believed suitable for fastener 2. There are thus provided various means for releasably connecting a free distal end of loop 62 to the inner belt.

The above description is given by way of example, and not limitation. Given the above disclosure, one skilled in the art could devise variations that are within the scope and spirit of the invention disclosed herein, including various ways of configuring and locating the fasteners 2 and the arches 4 and a variety of connectors 2 could be used. Likewise, a variety of adjustable connectors 5, 23 could be used for connecting the ends of the inner belt 1 or belt portions 1*a*, 1*b*. Additionally, various stiffeners 56 could be used to support the loops 52, 53 and the loops 52, 53 can be fastened to the inner belt 1 various ways. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A method of supporting a garment worn around a user's waist, the garment having a waistband with a waistline with a plurality of external belt loops and an external belt threaded through the external belt loops, the user having an extending stomach and having thighs and hips, with a crotch between the thighs and hips, comprising:

placing a inner belt along the juncture of the stomach and thighs, the inner belt having two arches located on opposing sides of the crotch with each arch having a front end adjacent the crotch and a rear end adjacent and in front of the hips, the inner belt having at least one first loop supported by each arch, and at least one second loop supported by the inner belt and located between the rear ends of the arches;

threading the exterior belt through the external belt loops and supporting the weight of the garment on the external belt;

threading the exterior belt through the first and second loops and supporting the weight of the external belt on the inner belt and arches.

2. The method of claim 1, further comprising supporting the external belt on each arch by two first loops connected to each arch and by a second loop connecting a back of the inner belt to a back of the external belt.

3. The method of claim 1, further comprising supporting the external belt at two locations on each arch.

4. The method of claim 1, wherein the inner belt is formed of two portions each of which is connected to one arch, the method further comprising connecting the two portions with an adjustable length connector located between the rear ends of the arches and adjusting that length to the user's body.

5. The method of claim 3, further comprising forming the inner belt of two portions each of which is connected to one arch and connecting the two portions with an adjustable length connector located between the second ends of the arches and further located along the user's back during use.

6. The method of claim 1, further comprising supporting a top of the first loops above the waistline of the garment.

* * * * *